US010894263B2

(12) United States Patent
Butler et al.

(10) Patent No.: US 10,894,263 B2
(45) Date of Patent: Jan. 19, 2021

(54) AEROSOL DISPENSER

(71) Applicant: Conopco, Inc., Englewood Cliffs, NJ (US)

(72) Inventors: Joseph Butler, Rugby (GB); Timothy John Taylor Davies, Belboroughton (GB); Christopher John Jones, Tewkesbury (GB); Timothy Christopher Stubbs, Birmingham (GB); Andrew Gordon Wallace, Northampton (GB)

(73) Assignee: Conopco, Inc., Englewood Cliffs, NJ (US)

( * ) Notice: Subject to any disclaimer, the term of this patent is extended or adjusted under 35 U.S.C. 154(b) by 251 days.

(21) Appl. No.: 16/061,491

(22) PCT Filed: Nov. 18, 2016

(86) PCT No.: PCT/EP2016/078130
§ 371 (c)(1),
(2) Date: Jun. 12, 2018

(87) PCT Pub. No.: WO2017/102250
PCT Pub. Date: Jun. 22, 2017

(65) Prior Publication Data

US 2020/0188945 A1 Jun. 18, 2020

(30) Foreign Application Priority Data

Dec. 18, 2015 (EP) ..... 15201409

(51) Int. Cl.
*B05B 11/00* (2006.01)
*B65D 53/02* (2006.01)
*B65D 83/38* (2006.01)

(52) U.S. Cl.
CPC ..... *B05B 11/0013* (2013.01); *B05B 11/3047* (2013.01); *B65D 53/02* (2013.01); *B65D 83/38* (2013.01); *B65D 2251/20* (2013.01)

(58) Field of Classification Search
CPC . B05B 11/0013; B05B 11/3047; B65D 53/02; B65D 83/38; B65D 2251/20
(Continued)

(56) References Cited

U.S. PATENT DOCUMENTS 3,349,974 A 10/1967 Raehs
3,806,005 A 4/1974 Mason
(Continued)

FOREIGN PATENT DOCUMENTS

DE 3122982 12/1982
EP 2641660 9/2013
(Continued)

*Primary Examiner* — Donnell A Long
(74) *Attorney, Agent, or Firm* — Greenberg Traurig, LLP

(57) ABSTRACT

An aerosol dispenser comprising a pressurised aerosol can and a closure comprising an aerosol valve held within a retention chassis, the retention chassis being associated with a flexible sealing collar designed to radially surround the retention chassis and to seal against the edge of an opening in the aerosol can, wherein the retention chassis is axially moveable relative to the sealing collar and wherein the sealing collar is of outer diameter greater than the inner diameter of the opening in the aerosol can and is sufficiently flexible to flex through the opening in the aerosol can when the retention chassis is in a first axial position relative to the sealing collar and wherein the sealing collar is firmly held against the edge of the opening in the aerosol can when the retention chassis is in a second axial position relative to the sealing collar.

1 Claim, 4 Drawing Sheets

(58) Field of Classification Search
USPC ..... 222/402.1, 402.21
See application file for complete search history.

(56) References Cited

U.S. PATENT DOCUMENTS

| | | | | |
|---|---|---|---|---|
| 4,762,254 | A * | 8/1988 | Nitta | B65D 83/38 222/402.1 |
| 4,795,045 | A * | 1/1989 | Radtke | B65D 83/38 215/325 |
| 5,348,174 | A * | 9/1994 | Velicka | B05B 11/3049 215/277 |
| 6,189,741 | B1 | 2/2001 | Behar | |
| 6,279,786 | B1 | 8/2001 | De Pous | |
| 6,527,149 | B1 | 3/2003 | Garcia | |
| 2004/0069812 | A1 | 4/2004 | Beranger | |
| 2004/0173639 | A1 | 9/2004 | Cater | |
| 2007/0245538 | A1* | 10/2007 | Salameh | B29C 66/1224 29/453 |
| 2011/0240679 | A1* | 10/2011 | Langlos | B05B 11/3049 222/321.7 |
| 2013/0082074 | A1 | 4/2013 | Armstrong | |
| 2020/0148461 | A1* | 5/2020 | Zeik | B65D 83/44 |

FOREIGN PATENT DOCUMENTS

| | | |
|---|---|---|
| GB | 2344621 | 6/2000 |
| NL | 6514488 | 5/1966 |
| WO | WO15130220 | 9/2015 |

* cited by examiner

AEROSOL DISPENSER

FIELD OF INVENTION

The present invention is in the field of aerosol dispensers, in particular aerosol dispensers comprising plastic inserts.

BACKGROUND

A variety of aerosol dispensers has been disclosed in previous years. Some of those most similar to the design involved in the present invention are described below.

US2004069812A (Valois, 2004) discloses an aerosol dispenser with a fixing member for fixing a valve body in the opening in the top of the aerosol can, the fixing member being provided with a skirt serving to engage with the opening in the aerosol can.

U.S. Pat. No. 6,527,149B (Valois, 2006) discloses a fluid dispenser having a fixing member that cooperates with the inside wall of the neck of the dispenser.

GB2344621A (Bespak, 2000) discloses a seal arrangement for a pressurised dispensing container, the seal arrangement having a gasket portion and a tapered sealing collar.

U.S. Pat. No. 6,189,741B (Teleplastics, Valois, 2001) discloses an aerosol dispenser with a distribution device engaged in the opening of the container by the intermediary of a bushing and a sleeve.

DE3122982A1 (Lechner and Bek GmbH, 1982) discloses a closure cap for pressurised containers in which the cap edge is provided with a holding part, which engages the edge bead of the container, and the cap body is made of plastic.

U.S. Pat. No. 3,806,005A (Dart Ind. Inc., 1974) discloses an aerosol dispenser plug in cap and valve structure comprising resiliently deflectable elements.

GENERAL DESCRIPTION

A problem common to aerosol dispensers is the difficulty in removing the aerosol valve, a difficulty that has significant repercussions on the recyclability of the dispenser. The present invention involves a unique and innovative solution to this problem. In addition, the present invention can lead to improvements in leak reduction.

The invention comprises specific features involved in fastening an aerosol valve to an aerosol can, said features being axially mobile relative to one another such that in one relative axial positioning, the aerosol valve may be removed from the aerosol can whilst in another relative axial positioning, the aerosol valve may not be removed from the aerosol can.

In a first aspect of the present invention, there is provided an aerosol dispenser comprising a pressurised aerosol can and a closure therefor, the closure comprising an aerosol valve held within a retention chassis, said retention chassis being associated with a flexible sealing collar designed to radially surround the retention chassis and to seal against the edges of an opening in the aerosol can, wherein the retention chassis is axially moveable relative to the sealing collar and wherein the sealing collar is of outer diameter greater than the inner diameter of the opening in the aerosol can and is sufficiently flexible to flex through the opening in the aerosol can when the retention chassis is in a first axial position relative to the sealing collar and wherein the sealing collar is firmly held against the edges of the opening in the aerosol can when the retention chassis is in a second axial position relative to the sealing collar.

In a second aspect of the present invention, there is provided a method for applying an aerosol composition to a surface comprising the use of a dispenser according to the first aspect of the invention. This aspect of the invention is particularly useful in applying cosmetic compositions to the surface of the human body.

In a third aspect of the present invention, there is provided a method of assembly of a dispenser according to the first aspect of the invention, said method comprising the steps of:

(i) holding the retention chassis in a first position relative to the flexible sealing collar such that the sealing collar may flex through the opening in the aerosol can;

(ii) axially moving the retention chassis relative to the sealing collar to a second position, such that the sealing collar is firmly held against the edges of the opening in the aerosol can by the retention chassis.

In both the products and methods according to the present invention, the aerosol valve may be easily removed from the dispenser at the end of the product's useful life, i.e. when the composition contained within the dispenser has been exhausted.

A further benefit of the present invention is that standard actuators can be fitted. This is of great commercial benefit, allowing interchangeable use of a variety of off-the-shelf actuators.

DETAILED DESCRIPTION

In preferred embodiments, the retention chassis and/or associated sealing collar (6) are made of plastic and are preferably elastomeric. In particularly preferred embodiments, the retention chassis and associated sealing collar are made of plastic, and are preferably elastomeric. A benefit of these preferred embodiments is that the dispenser can be made more lightweight. A further benefit is that the specified components are more flexible, easing manufacture and the insertion and removal of the aerosol valve.

Herein, references to the insertion and removal of the aerosol valve should be understood to include insertion and removal of the associated retention chassis and sealing collar, unless otherwise specified.

Herein, references to the retention chassis and sealing collar being "axially moveable" relative to one another does not mean that such movement cannot be prevented in some circumstances. For example, when the retention chassis and sealing collar are in place on top of a pressurised aerosol can, inward axial movement of the retention chassis may be prevented by the pressure within the can and/or structural interactions and outward axial movement may be prevented by other structural interactions.

Herein "inward axial movement" should be understood to mean movement along the long axis of the aerosol can towards its axial centre and "outward axial movement" should be understood to mean movement along the long axis of the aerosol can away from its axial centre.

Herein, "plastic" should be understood to refer to a material that comprises organic polymers and that is malleable, particularly at elevated temperatures, and can be moulded into various shapes.

Herein, "elastomeric" should be understood to refer to a material such as natural or synthetic rubber that is able to resume its original shape when a deforming force is removed.

Herein, orientation terms such as "horizontal/vertical" and "upper/lower" should be understood to refer to the dispenser and/or components thereof oriented in an upright manner with the outlet from the aerosol valve towards the top.

In preferred embodiments, the outer edge of the sealing collar seals directly against the inner edge of the opening in the aerosol can. Particularly effective and efficient sealing is achieved in this way.

In preferred embodiments, the sealing collar comprises an annular protrusion that interacts with the inner edge of the opening in the aerosol can to resist removal of the sealing collar from the aerosol can once it has been inserted. This adds to the robustness of the assembly.

In preferred embodiments, the sealing collar is designed to flex through the opening in the aerosol can when the retention chassis is axially spaced from the sealing collar and is designed to be firmly held against the edge of the opening in the aerosol can by the retention chassis when the retention chassis is less axially spaced from the sealing collar. In particularly preferred embodiments of this type, the retention chassis is designed to be moved axially outwards into the centre of the radially surrounding sealing collar in order to seal it against the edge of the opening in the aerosol can once the retention chassis has been flexed through the opening in the aerosol can.

A preferred feature of the sealing collar is that it has ribs, preferably having axial orientation, protruding from its outer circumference. Such ribs can increase torque between the sealing collar and any actuator that sits over it, a common arrangement in dispensers for which the present invention is intended to have value. The value of such ribs is even greater when the sealing collar is made of a natural or synthetic rubber. The benefit attained improves the robustness of the overall dispenser by reducing undesirable rotation of the actuator relative to the sealing collar and associated can.

When the retention chassis is in its first position relative to sealing collar, i.e. when the two are axially spaced from each other, they may or may not be associated.

The retention chassis is typically capable of being associated with the sealing collar in axial positions that are more and less axially spaced, the least axially spaced position resulting in the sealing collar being held firmly against the edge of the opening aerosol can.

When the retention chassis is in its second position relative to sealing collar, i.e. when the two are less axially spaced from each other, they are associated, the retention chassis pressing outwards on the sealing collar and holds it firmly to the edge of the opening aerosol can.

When the retention chassis is in its second axial position relative to the sealing collar and the sealing collar is firmly held against the edges of the opening in the aerosol can the sealing collar cannot flex through the opening in the aerosol can.

In preferred embodiments, it is the retention chassis itself that holds the sealing collar against the edge of the opening in the aerosol can when the retention chassis is in its second axial position relative to the sealing collar.

The retention chassis preferably extends radially across at least 40%, more preferably at least 50% and most preferably at least 60% of the diameter of the aerosol can. In each of these preferred embodiments, it is desirable for the retention chassis extends radially no more than 90% across the diameter of the can in order to ensure good retaining of the retention chassis by the aerosol can.

The sealing collar and retention chassis may be assembled onto the aerosol can in methods comprising the following independently preferred features. The aerosol can is positioned appropriately, preferably having been first filled with the non-propellant components of the composition to be sprayed. The aerosol valve and its retention chassis is flexed through the opening in the top of the aerosol can. The sealing collar is assembled onto the opening in the aerosol can. The retention chassis is axially lifted outwards, optionally under vacuum, to engage with the sealing collar and thereby firmly anchor it to the edge of the aerosol can. Sealing gaskets are placed between the aerosol can and the sealing collar and between the sealing collar and the retention chassis to ensure gas-tight sealing. The dispenser is then gassed as per standard practice in the art.

Removal of the aerosol valve from the aerosol can at the end of useful life of the dispenser is easily achieved once all the pressure has been released from the can, typically via full use of the composition previously contained within. Typically, the aerosol can is removed together with its associated retention chassis by axially moving the retention chassis from its first position to its second and then removing the retention chassis from being associated with the sealing collar. This enables the flexible sealing collar to be easily removed and all components of the dispenser to be independently recycled. Axially moving the retention chassis from its first position to its second is typically done by a reversal of the procedure used in assembly to move it from its first position to its second.

SPECIFIC EMBODIMENTS

The features described with reference to the following specific embodiments may be considered preferred features of the generic description given above and/or may be incorporated independently into the subject matter as described the following claims.

Figure 1:
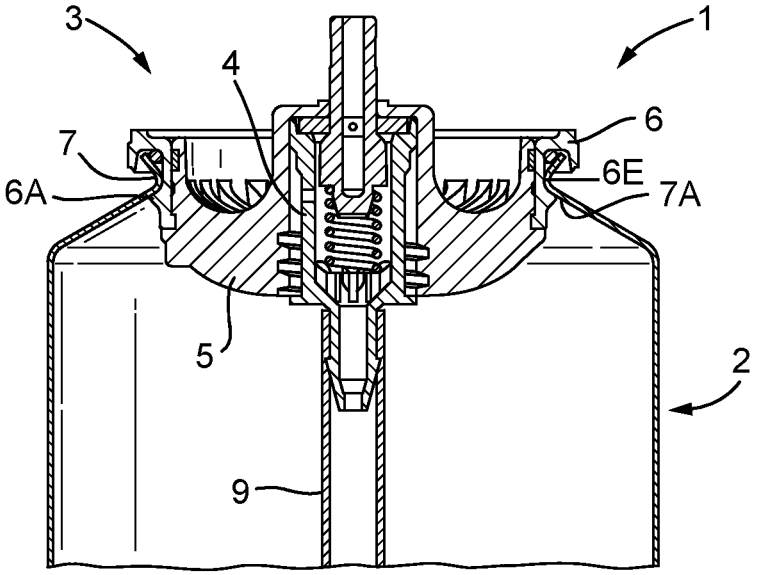
FIG. 1 is cross-section through a first embodiment according to the invention, focussing on the closure (3) therefor.

In the first embodiment as represented in FIGS. 1 to 6, the aerosol dispenser (1) comprises an aerosol can (2) and closure (3) therefor. The closure (3) comprises an aerosol valve (4) held within a retention chassis (5), the retention chassis (5) being associated with and surrounded by a sealing collar (6). The sealing collar (6) seals against the edge (7) of an opening (8) at the top of the aerosol can (2). The sealing collar (6) has an annular outward protrusion (6A) that interacts with the inner surface (7A) of the opening (8) in the aerosol can (2) to resist removal of the sealing collar (6) from the aerosol can (2) once it has been inserted.

The edge (7) of the opening (8) of the aerosol can (2) is out-turned, enabling double sealing points when the dispenser (1) is fully assembled. In addition to the sealing between the inner surface (7A) of the opening (8) and the annular outward protrusion (6A) from the sealing collar (6)

there is also a sealing against an O-ring (10) located towards the top outer edge (6E) of the sealing collar (6). This double sealing ensures a gas-tight fitting of the sealing collar (6) against the inner surface (7A) of the opening (8) in the aerosol can (2) and this sealing is enforced by the presence of the retention chassis (5) (vide infra).

The outer diameter of the sealing collar (6) measured to the edge of the annular outward protrusion (6A) is greater than the inner diameter of the opening (8) in the aerosol can (2). This means that the sealing collar (6) must be flexed inwards to get it into the aerosol can (2) during manufacture.

Figure 2:
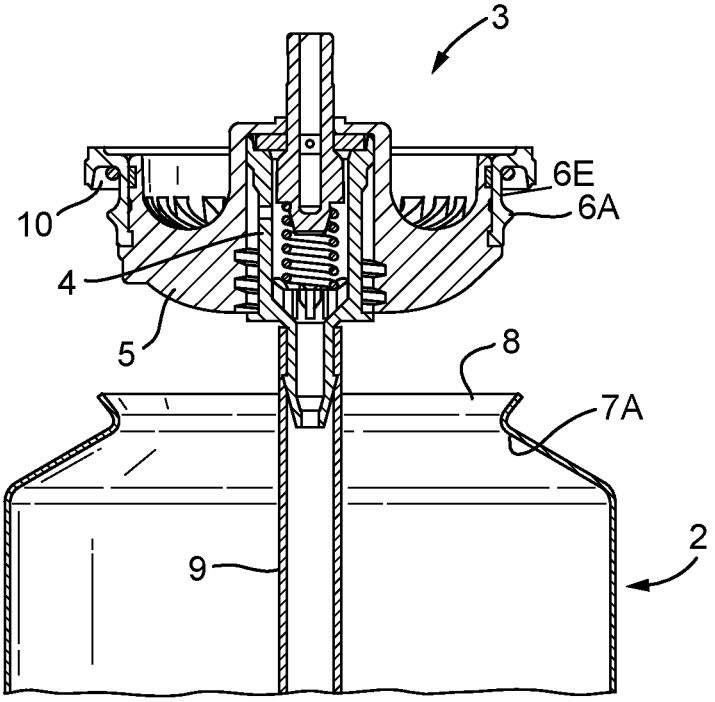
FIG. 2 is an exploded cross-sectional view through the aerosol dispenser (1) illustrated in FIG. 1, with the closure (3) and an associated dip-tube (9) separated from the aerosol can (2).

Also illustrated in FIGS. 1 and 2 are several features of the aerosol valve (4) and an associated dip-tube (9). As these features are common in the art, they will not be further discussed herein.

Figure 3:
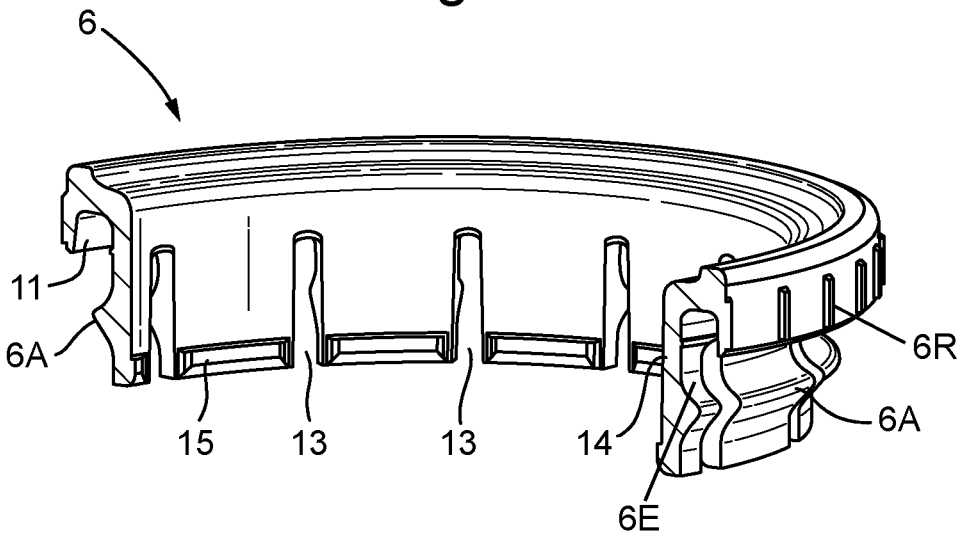
FIG. 3 is a sectional view of the sealing collar (6) present in the embodiment illustrated in FIGS. 1 and 2.

The sealing collar (6) is illustrated in more detail in FIG. 3. The sealing collar (6) loops over at its top end to create an annular recess (11) into which the out-turned edge (7) of the opening (8) of the aerosol can (2) fits when the dispenser (1) is assembled, together with the aforementioned O-ring (10) (vide supra).

The sealing collar (6) comprises several radially dispersed vertical slits (13) in its annular wall (14). These slits (13) open to the bottom of the annular wall (14) and aid the flexibility of collar (6), enabling it to flex through the opening (8) in the aerosol can (2) during manufacture. In preferred embodiments, its material of construction, being plastic and preferably being elastomeric, also aids the flexibility of the sealing collar (6).

The sealing collar (6) also comprises an annular bead (15) around the lower inner edge of the annular wall (14) of the sealing collar (6), this bead (15) being interrupted by the aforementioned vertical slits (13) in the annular wall (14). This bead (15) serves to anchor the sealing collar (6) to the retention chassis (5) when the dispenser (1) is fully assembled.

The sealing collar (6) comprises axially orientated ribs (6R) protruding from its outer circumference. These ribs serve to increase the torque between the sealing collar and any actuator that sits over it.

Figure 4:
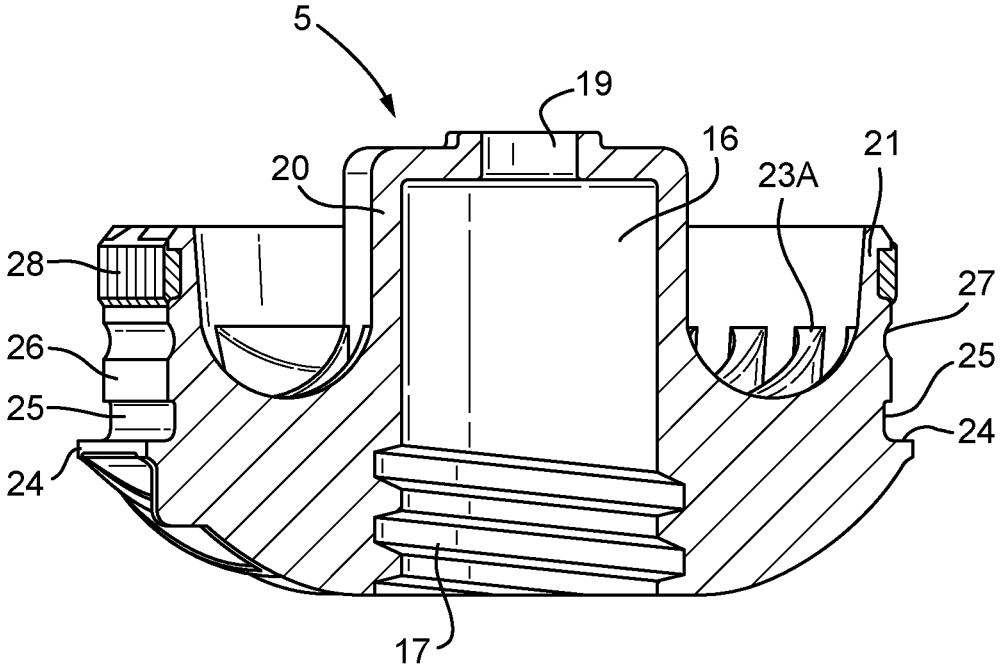
FIGS. 4 and 5 are sectional views of the retention chassis (5) present in the embodiment illustrated in FIGS. 1 and 2, FIG. 5 being an inverted sectional view.
Figure 5:
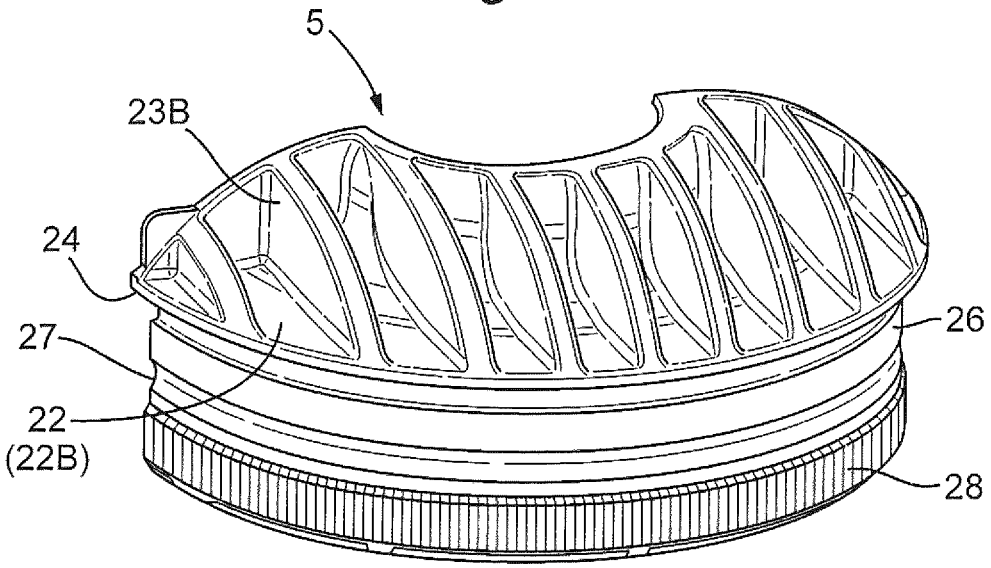

The retention chassis (5) is illustrated in further detail in FIGS. 4 and 5. It comprises a cylindrical vault (16) running axially through its centre for accommodating and holding the aerosol valve (4). The aerosol valve (4) is held in place by means of a screw thread (17) located towards the inner (lower) end of the vault (16). The valve stem (18) (vide infra) of the aerosol valve (4) protrudes through the valve stem orifice (19) at the outer (upper) end of the vault (16).

The cylindrical vault (16) covers approximately a third of the diameter of the retention chassis (5) and is bordered by a vault wall (20). The vault wall (20) is separated from an outer wall (21) of the retention chassis (5) by an annular plane (22). The annular plane (22) bears multiple support struts (23A and 23B) running between the outer surface of the vault wall (20) and the upper (22A, not illustrated) and lower surfaces (22B) of the annular plane (22) producing a resilient yet lightweight structure.

The outer wall (21) of the retention chassis (5) has important features for its interaction with the sealing collar (6). Towards its lower outer edge, the outer wall (21) has a ledge (24). This ledge (24) serves to limit upward movement of the retention chassis (5) relative to the sealing collar (6) by interaction with the bottom of the annular wall (14) of the sealing collar (6). In addition, the outer wall (21) is relatively thin and has a certain flexibility relating to its material of construction, which is typically plastic and preferably elastomeric.

The outer wall (21) of the retention chassis (5) also has an annular recess (25) into its outer surface adjacent to the ledge (24). This annular recess (25) serves to accommodate the annular bead (15) which exists around the lower inner edge of the annular wall (14) of the sealing collar (6). The interaction between the annular bead (15) and the annular recess (25) serves to anchor the retention chassis (5) in the sealing collar (6) when the dispenser (1) is fully assembled, restricting downward movement of the retention chassis (5) relative to the sealing collar (6).

As one progresses upwards around the outer surface of the outer wall (21) of the retention chassis (5), one finds a flat annular section (26) above the annular recess (25) referred to in the previous paragraph and then above this there is an annular groove (27). The flat annular section (26) has an important function when the dispenser (1) is fully assembled in that it pressurises the annular wall (14) of the sealing collar (6) outwards and forces the annular outward protrusion (6A) therefrom into contact with the with the inner surface (7A) of the opening (8) in the aerosol can (2).

Above the annular groove (27) referred to in the previous paragraph, there is a further section of wall bearing a resilient sealing gasket (28). When the dispenser (1) is fully assembled, the gasket (28) helps to press on the outer wall (21) which in turn presses the O-ring (10) into contact with the inner surface (7A) of the opening (8), where said edge is out-turned. When so pressed, the O-ring (10) augments the gas-tight seal between the sealing collar (6) and the inner surface (7A) on the aerosol can (2).

Figure 6:
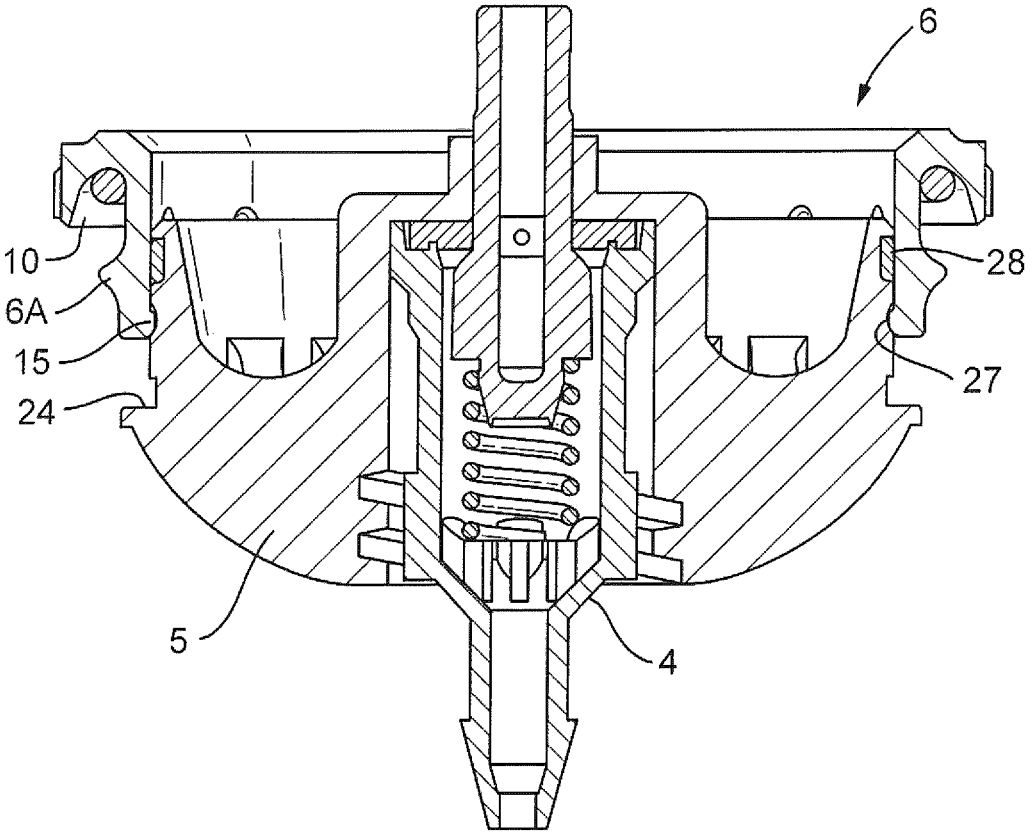
FIG. 6 is a cross-section through the closure (3) illustrated in FIGS. 1 and 2 with the chassis (5) axially offset from the sealing collar (6).

FIG. 6 illustrates the retention chassis (5) and sealing collar (6) in a relative positioning they adopt during pre-assembly storage and when the sealing collar (6) is forced through the opening (8) in the aerosol can (2). In this positioning, the two components are held together via an interaction between the annular bead (15) around the lower inner edge of the annular wall (14) of the sealing collar (6) and the annular groove (27) in the outer surface of the outer wall (21) of the retention chassis (5). During manufacture, the sealing collar (6) needs to flex through the opening (8) in the aerosol can (2). It does so with the aid of the vertical slits (13) in the annular wall (14) of the sealing collar (6) and the flexible nature of the outer wall (21) of the retention chassis (5), which sits immediately within the sealing collar (6). When the sealing collar (6) and associated retention collar (5) have passed through the opening (8) in the top of the aerosol can (2), the O-ring (10) is trapped in the annular recess (11) at the top sealing collar (6) by the out-turned inner surface (7A) of the opening (8). The retention chassis (5) is then pulled outwards, optionally by use of a vacuum, to the extent allowed by the aforementioned ledge (24) in the outer wall (21) of the retention chassis (5).

Removal of the aerosol valve (4) from the aerosol (2) can once all the pressure has been released is achieved quite simply. In the absence of internal pressure, the retention chassis (6) may be pushed through the sealing collar (5) be applying sufficient force to get the annular bead (15) projecting inwardly from the sealing collar (6) to be pushed out of the annular recess (25) in the retention chassis (25). The valve (4) and associated retention chassis (5) then fall into the aerosol can (2) and the flexibly sealing collar (6) may be easily removed, prior to also emptying the valve (4) and retention chassis (5) from the inside of the can (2).

Figure 7:
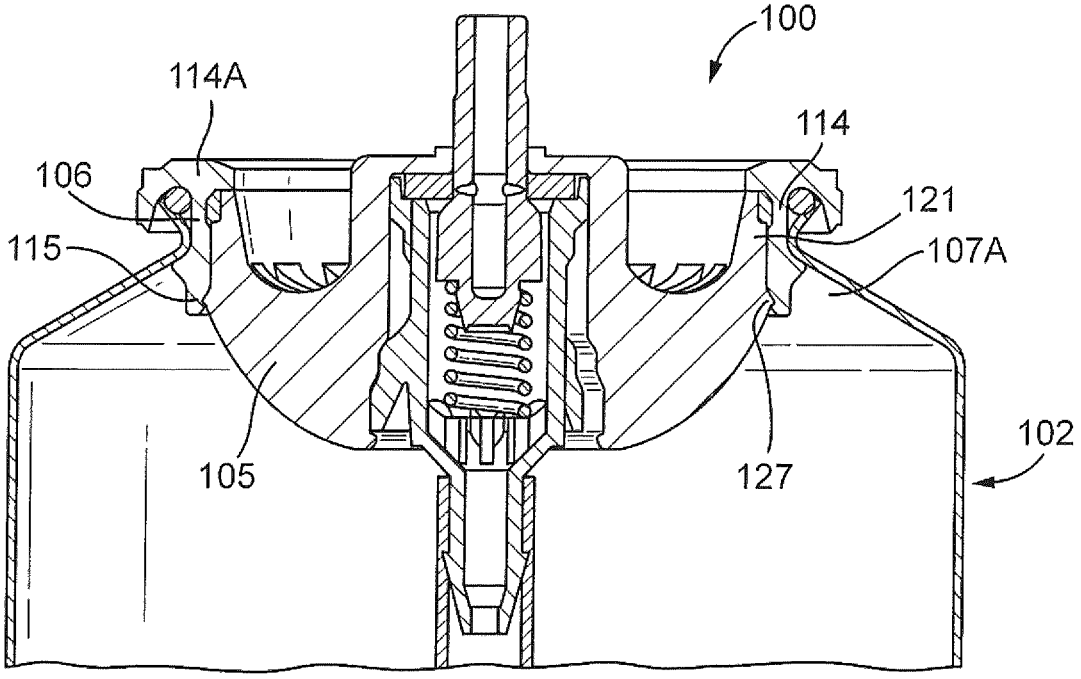
FIG. 7 is a cross-section through a second embodiment of the present invention.

FIG. 7 illustrates a second embodiment according to the present invention. This embodiment is similar to the first embodiment, but has somewhat different interactions between the retention chassis (105) and the sealing collar (106). In particular, the sealing collar (106) has an annular inward projecting ledge (1114A) at the top of its annular wall (114). This serves to prevent further outward movement of the retention chassis (105) when the dispenser (100) is fully assembled, the top of the outer wall (121) of the retention chassis (105) abutting the lower surface of the ledge (114A) in this position.

As with the first embodiment of the invention, the second embodiment illustrated in FIG. 7 involves the retention chassis (105) being moved outwards relative to the sealing collar (106) in order to lock the sealing collar (106) into contact with the inner surface (107A) of the aerosol can (102). In this latter embodiment, the lower inner surface of the annular wall (114) of the sealing collar (106) recedes radially outwards and then forms an inwardly projecting retention bead (115) which clips under an outwardly projecting ledge (124) from the outer surface of retention chassis (105) when the retention chassis (105) has been drawn outwards to its maximum extent. This interaction between the outwardly projecting ledge (124) of the retention chassis (105) and the retention chassis (105) of the sealing collar (106) restricts downward movement of the retention chassis (105) relative to the sealing collar (106) when the dispenser (100) is fully assembled.

Figure 8:
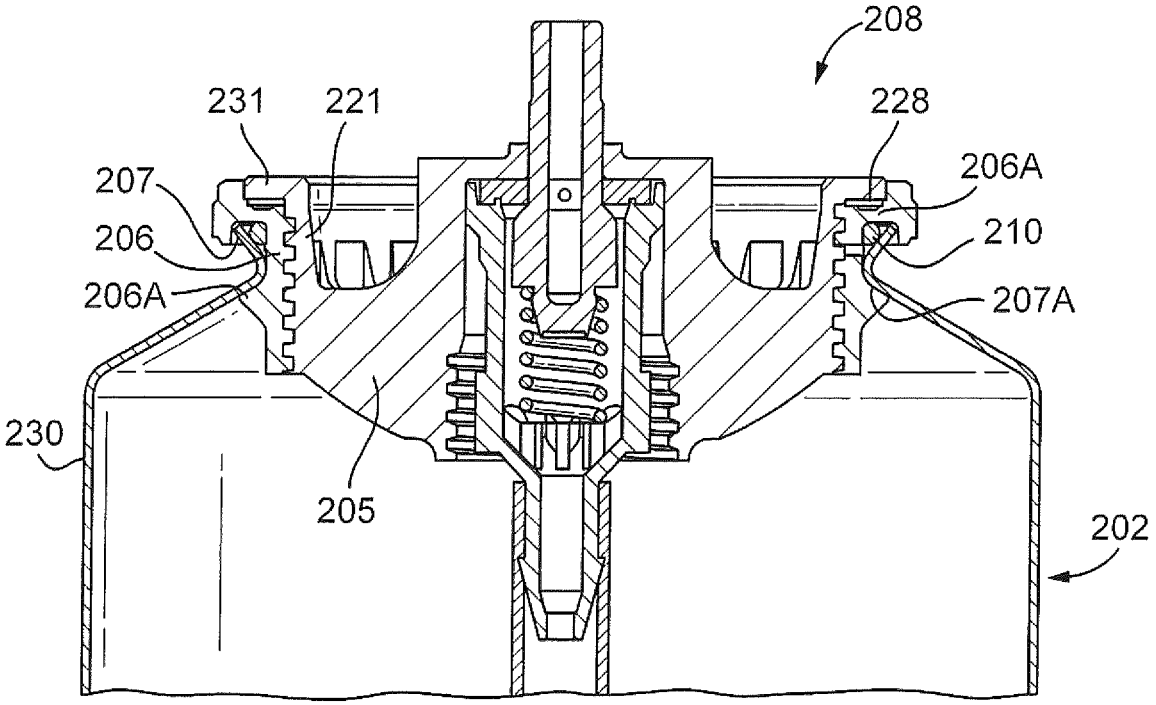
FIG. 8 is a cross-section through a third embodiment of the present invention.

FIG. 8 illustrates a third embodiment according to the present invention. This embodiment is different to the first and second embodiments in that the retention chassis (205) is moved inwards relative to sealing collar (206) in order to lock the sealing collar (206) into contact with the inner surface (207A) of the aerosol can (202). In this embodiment, the retention chassis (205) is moved downwards (inwards) by means of a screw thread (230) between the outer surface of the retention chassis (205) and the inner surface of the sealing collar (206).

The third embodiment as illustrated in FIG. 8 has a sealing gasket (228) present between the retention chassis (205) and the sealing collar (206). This sealing gasket (228) is held between the lower surface of an annular protrusion (231) from an outer wall (221) of the retention chassis (205) and an annular section (206A) of the sealing collar (206) that extends radially outwards over the out-turned edge (207) of the aerosol can (202).

The third embodiment also has an O-ring (210) held between the out-turned edge (207) of the aerosol can (202) and the outer surface of the retention chassis (205). This helps seal the sealing collar (206) against the aerosol can (202) together with an annular protrusion (206A) that interacts with the inner surface (207A) of the aerosol can (202) to resist removal of the sealing collar (206) from the aerosol can (202) once it has been inserted.

Insertion of the (flexible) sealing collar (206) of the third embodiment illustrated in FIG. 8 through the opening (208) in the aerosol can (202) is achieved when the retention chassis (205) is largely unscrewed (axially disengaged) from the sealing collar (206). The flexibility of the sealing collar (206) is aided by radially dispersed vertical slits (213, not illustrated) similar to the vertical slits (13) present in the first embodiment illustrated in FIGS. 1 to 6.

When the retention chassis (205) is subsequently screwed downwards into the sealing collar (206), the sealing collar (206) becomes firmly held against the inner surface (207A) of the aerosol can (202).

The invention claimed is:

1. A method of assembly of an aerosol dispenser comprising:

holding the retention chassis in a first position relative to the flexible sealing collar such that the sealing collar may flex through the opening in the aerosol can;

axially moving the retention chassis relative to the sealing collar to a second position, such that the sealing collar is firmly held against the edge of the opening in the aerosol can by the retention chassis;

wherein the retention chassis is first placed within the aerosol can, the sealing collar is then affixed to the opening in the aerosol can and the retention chassis is then moved axially outwards to engage with the sealing collar and firmly hold it against the edge of the opening in the aerosol can;

producing a pressurised aerosol can, and a closure;

wherein the closure comprises an aerosol valve held within a retention chassis, the retention chassis being associated with a flexible sealing collar designed to radially surround the retention chassis and to seal against an edge of an opening in the aerosol can;

wherein the retention chassis is axially moveable relative to the sealing collar and wherein the sealing collar is of outer diameter greater than the inner diameter of the opening in the aerosol can and is sufficiently flexible to flex through the opening in the aerosol can when the retention chassis is in a first axial position relative to the sealing collar;

wherein the sealing collar is firmly held against the edge of the opening in the aerosol can by the retention chassis when the retention chassis is in a second axial position relative to the sealing collar;

wherein, in the first axial position, the retention chassis is axially spaced from the sealing collar and in the second axial position the retention chassis is less axially spaced from the sealing collar;

wherein the retention chassis is designed to be moved axially outwards into the centre of the radially surrounding sealing collar in order to seal it against the edge of the opening in the aerosol can once the retention chassis has been flexed through the opening in the aerosol can;

wherein the sealing collar has an outer edge sealed directly against the inner surface of the opening in the aerosol can;

wherein the sealing collar comprises an annular protrusion that interacts with the inner surface of the opening in the aerosol can to resist removal of the sealing collar from the aerosol can once it has been inserted;

wherein at least one of the retention chassis and the sealing collar is elastomeric;

wherein the retention chassis extends radially across at least 40% of the diameter of the aerosol can;

wherein the aerosol valve is held centrally within the retention chassis;

wherein the retention chassis comprises an annular ledge that interacts with the sealing collar to resist outward axial movement of the retention chassis relative to the sealing collar;

wherein the aerosol valve has a screw-thread fitting to its retention chassis; and wherein the retention chassis is associated with the sealing collar by means of a screw thread.

* * * * *